US005088015A

United States Patent [19]

Baggio et al.

[11] Patent Number: 5,088,015

[45] Date of Patent: Feb. 11, 1992

[54] PORTABLE FLUORESCENT LAMP FIXTURE

[75] Inventors: Horacio A. Baggio, Niles; Mark D. Burrows, Barrington, both of Ill.

[73] Assignee: Woodhead Industries, Inc., Northbrook, Ill.

[21] Appl. No.: 721,410

[22] Filed: Jun. 26, 1991

[51] Int. Cl.[5] ..... F21L 3/00

[52] U.S. Cl. ..... 362/217; 362/226; 362/260

[58] Field of Search ..... 362/217, 221, 225, 226, 362/260

[56] References Cited

U.S. PATENT DOCUMENTS

| | | | |
|---|---|---|---|
| 2,525,537 | 10/1950 | Fletcher . | |
| 3,200,244 | 8/1965 | Meyer . | |
| 3,272,978 | 9/1966 | Jackson . | |
| 4,130,860 | 12/1978 | Careglio et al. | 362/217 |
| 4,268,894 | 5/1981 | Bartunek et al. | 362/217 |
| 4,477,863 | 10/1984 | Walz | 362/217 |
| 4,535,393 | 8/1985 | Aspenwall . | |
| 4,554,619 | 11/1985 | Bansbach et al. . | |
| 4,692,795 | 9/1987 | Nakas | 362/226 |
| 4,858,087 | 8/1989 | Hartshorn . | |
| 4,933,820 | 6/1990 | Engel . | |
| 4,980,808 | 12/1990 | Lilos . | |

*Primary Examiner*—Ira S. Lazarus
*Assistant Examiner*—Richard R. Cole
*Attorney, Agent, or Firm*—Emrich & Dithmar

[57] ABSTRACT

A portable fluorescent lamp fixture adapted for use with a plurality of fluorescent lamps includes an elongated center channel extending substantially the entire length of the fixture and disposed intermediate a pair of fluorescent lamps for providing a high strength, rugged structure. With a rubber end cap attached to each end of the center channel and a transparent protective tube comprised of polycarbonate or butyrate extending between the end caps and disposed about the center channel and fluorescent lamps, the lamp fixture is provided with a liquid-tight seal. The center channel includes an open lower portion along its length, having an inverted generally U-shaped cross-section, and is adapted to receive a removable snap-on cover along its entire length for enclosing lamp circuitry such as a ballast, a terminal block and wire leads. The removable cover facilitates access to lamp circuitry for maintenance. With a plug mounted to one end of the center channel and a receptacle mounted to its other end, the lamp fixture includes a quick connect/disconnect feature with power leads to other similar, serially coupled fluorescent lamp fixtures. Each end cap includes either a plug or receptacle integral with the end cap for mating with either a center channel receptacle or plug in a quick disconnect coupling arrangement. With the lamp end caps easily removed and all lamp circuitry disposed within the center channel with the removable cover, lamp maintenance is facilitated and lamp circuitry and wiring is protected during use.

16 Claims, 3 Drawing Sheets

PORTABLE FLUORESCENT LAMP FIXTURE

FIELD OF THE INVENTION

This invention relates generally to fluorescent lamp fixtures and is particularly directed to a rugged, sealed portable fluorescent lamp fixture which is easily coupled in series to other similar fixtures by means of a quick connect/disconnect coupling arrangement.

BACKGROUND OF THE INVENTION

Fluorescent lamp fixtures take on various shapes and forms. Perhaps the most common of such fixtures is installed in a ceiling and includes at least a pair of elongated fluorescent lamps arranged in parallel. Other fluorescent lamp fixtures are of the portable type for temporary use in various indoor environments ranging from construction sites to industrial plants and office spaces. Portable fluorescent lamp fixtures are typically suspended overhead and may be coupled together in series to illuminate large areas.

One such prior art portable fluorescent lamp fixture 10 is shown in the exploded perspective view of FIG. 1. The fluorescent lamp fixture 10 includes a generally rectangular, planar frame 12 typically comprised of sheet metal to which are attached first and second pairs of lamp holders 14 and 16. First and second fluorescent lamps 18 and 20 are coupled to and supported by first and second pairs of lamp holders 14, 16 on the lower surface of the frame 12 which also serves as a fixed reflector. One or more ballasts 26, 28 are also typically attached to the lower surface of the frame 12. Ballasts 26, 28 are coupled to other lamp fixture circuitry attached to an upper surface of the frame 12 and not shown in the figure. An elongated, linear channel 22 attached to an upper surface of the frame 12 by means of mounting screws 24 typically encloses and covers the lamp fixture circuitry and wiring disposed on the upper surface of the frame. Frame 12, the fluorescent lamps 18, 20 and lamp fixture circuitry attached to the frame are inserted in a tube-like elongated transparent housing 44 for protecting the fluorescent lamps and for serving as a lens for light emitted by the lamps. First and second end caps 32 and 34 are securely attached to respective ends of housing 44 and frame 12 by means of a combination of threaded studs **36*a* and 36*b* on the ends of the frame and nylon cap nut and washer combinations 38*a* and 38*b***.

The prior art fluorescent lamp fixture 10 shown in FIG. 1 has various limitations. For example, an electrical lead such as a power cord 42 coupled to the fluorescent lamp fixture 10 at one of its end caps 34 is hard wired to lamp circuitry on frame 12. Cord 42 is maintained in position in end cap 34 by means of a compression nut 48 and a grommet (not shown). In order to repair or replace components within the fluorescent lamp fixture 10 or to replace a fluorescent lamp, compression nut 48 and the grommet must first be removed, allowing the second end cap 34 to be slid down cable 42 for providing access to the wire connections within the fixture. It is difficult and time consuming to remove the grommet from a tapered aperture within end cap 34. The nylon cap nuts and washers **38*a* and 38*b* must then be removed to allow removal of the second end cap 34 from the fluorescent lamp fixture 10. Frame 12 and the first and second fluorescent lamps 18, 20 must then be withdrawn from one end of tubular housing 44. This procedure is not only time consuming and cumbersome, but also requires a support surface on the order of twice the length of the fluorescent lamp fixture 10, which may be as long as four feet in length. In addition, channel 22 must be removed by removing the various mounting screws 24 to gain access to circuitry and wiring on the upper surface of frame 12 for repairing or replacing components disposed on the upper surface of the frame. Lamp fixture maintenance and repair is made more difficult by the positioning of circuitry and wiring on both sides of frame 12. Finally, cord 42 is subject to frequent damage in the rough-handling environment to which portable fluorescent lamps fixtures are accustomed. The cord's outer insulating sheath is frequently damaged, or the cord itself may be severed, when impacted by an edge of an end cap which frequently occurs when the fluorescent lamp fixture 10** is dropped. The rough-handling environment of a temporary installation typically encountered by portable fluorescent lamp fixtures thus places severe demands upon the fluorescent lamp fixture.

OBJECTS AND SUMMARY OF THE INVENTION

The present invention is intended to overcome the above problems and provide an improved portable fluorescent lamp fixture which is easily maintained and repaired, is easily and quickly coupled in series to other similar fluorescent lamp fixtures, and provides electric cord protection on the ends of the fixture. The portable fluorescent lamp fixture includes an enclosed channel of metal with a removable cover running its length for providing the fluorescent lamp fixture with a high strength, rugged construction and for enclosing lamp fixture circuitry and wiring during operation while facilitating access to the circuitry and wiring by removal of the cover for maintenance and repair.

Accordingly, it is an object of the present invention to provide a portable fluorescent lamp fixture which is rugged and of high strength, is easily coupled in series to other similar lamp fixtures, and isolates and provides protection for circuitry within the fixture.

Another object of the present invention is to facilitate maintenance of a fluorescent lamp fixture by means of a pair of easily removed end caps to gain access to lamp fixture circuitry disposed within a closed channel running the length of the fixture and having a removable cover.

Yet another object of the present invention is t provide end caps for a portable fluorescent lamp fixture which afford a liquid-tight seal, facilitate electrically connecting or disconnecting the lamp fixture to other similar fixtures in series, and provide cord protection on the ends of the fixture.

This invention contemplates a portable fluorescent lamp fixture including a plurality of fluorescent lamps and associated circuitry and wires, the portable fluorescent lamp fixture comprising: an elongated, tube-like lamp guard open at both ends for enclosing the fluorescent lamps; first and second support plates each disposed on a respective end of the lamp guard; a plurality of lamp holders attached to each of the first and second support plates for engaging respective ends of the fluorescent lamps and coupling the fluorescent lamps to the circuitry and wires; a channel support member disposed within the lamp guard and coupled at respective ends thereof to each of the first and second support plates for substantially enclosing and maintaining the circuitry and wires in position within the lamp fixture; a removable cover disposed on the channel support member and over the circuitry and wires for enclosing the circuitry and wires; first and second end caps removably coupled to the first and second support plates, respectively; and a quick disconnect coupling for electrically coupling the portable fluorescent lamp fixture to a source of power, the quick disconnect coupling including a receptacle integral with the first end cap and removable therewith and a plug coupled to the first support plate and disposed within the channel support member and coupled to the circuitry and wires therein.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION

Figure 1:
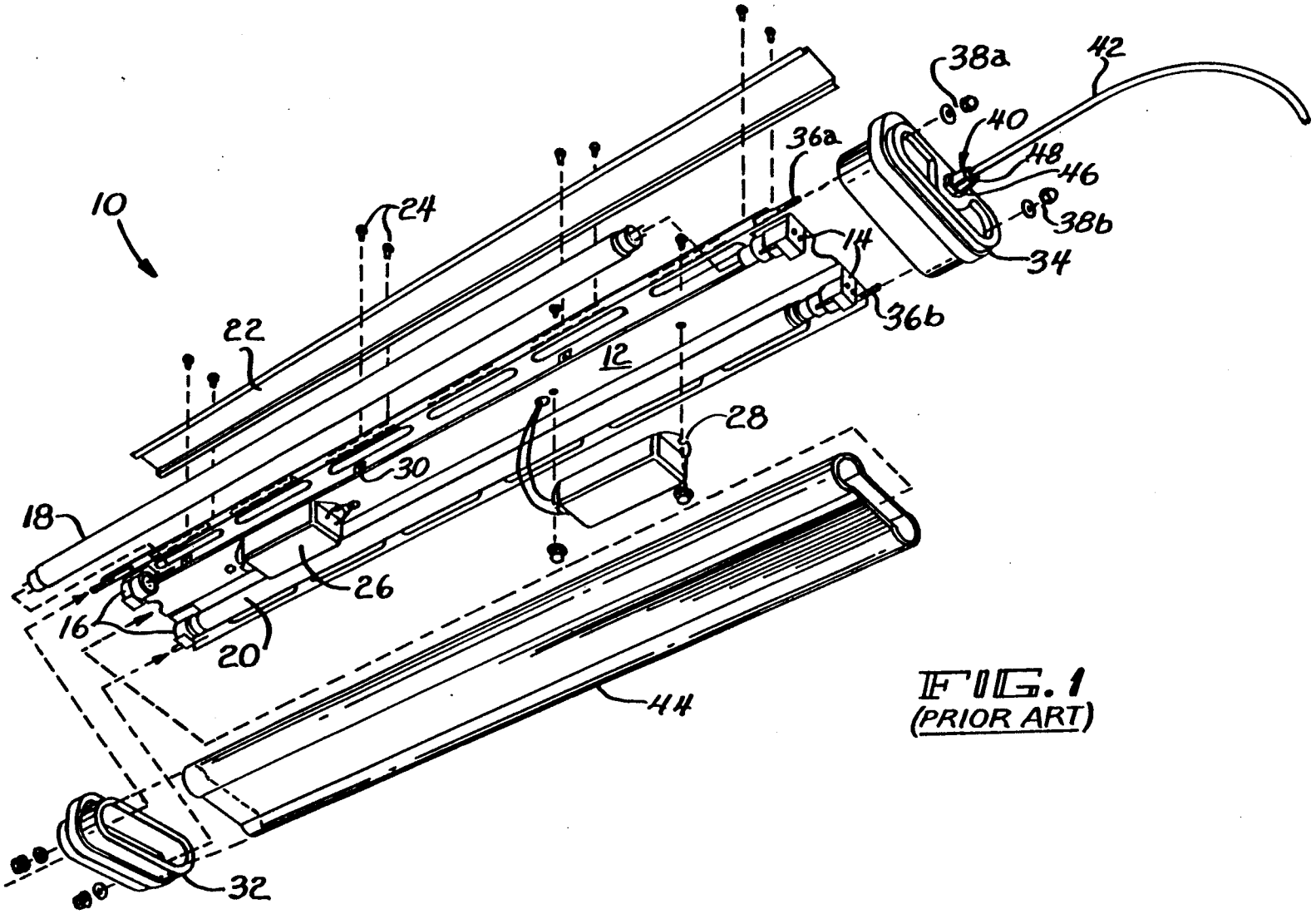
FIG. 1 (PRIOR ART)
FIG. 1 is an exploded perspective view of a prior art portable fluorescent lamp fixture.
Figure 2:
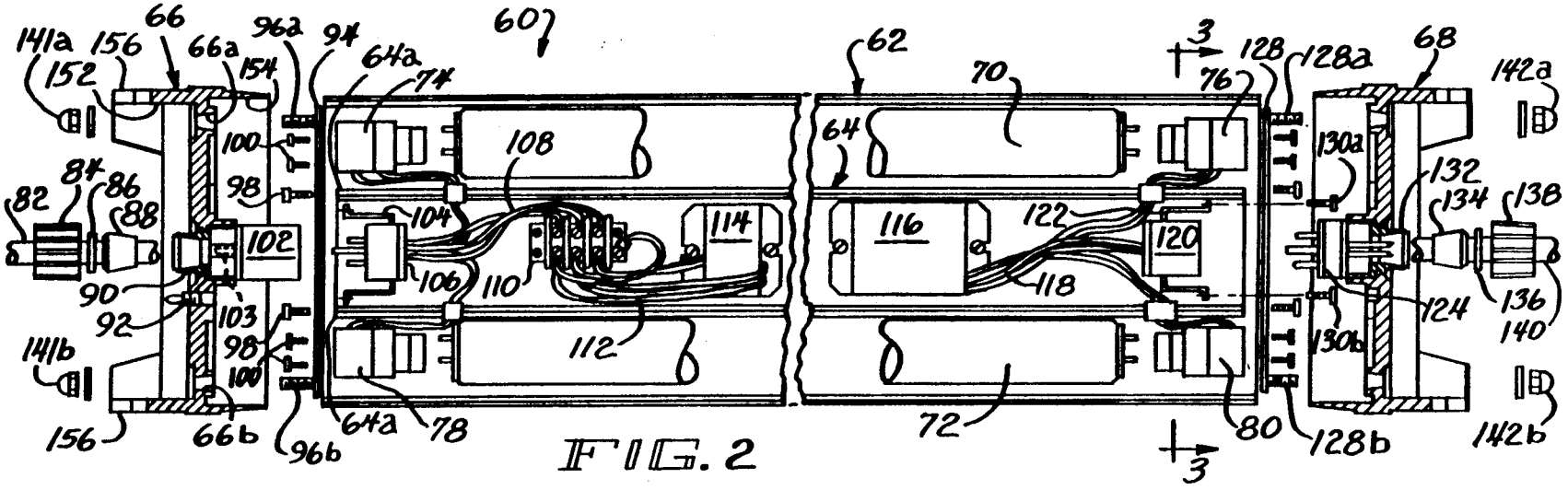
FIG. 2 is a sectional view, shown partially exploded, of a portable fluorescent lamp fixture in accordance with the present invention.
Figure 5:
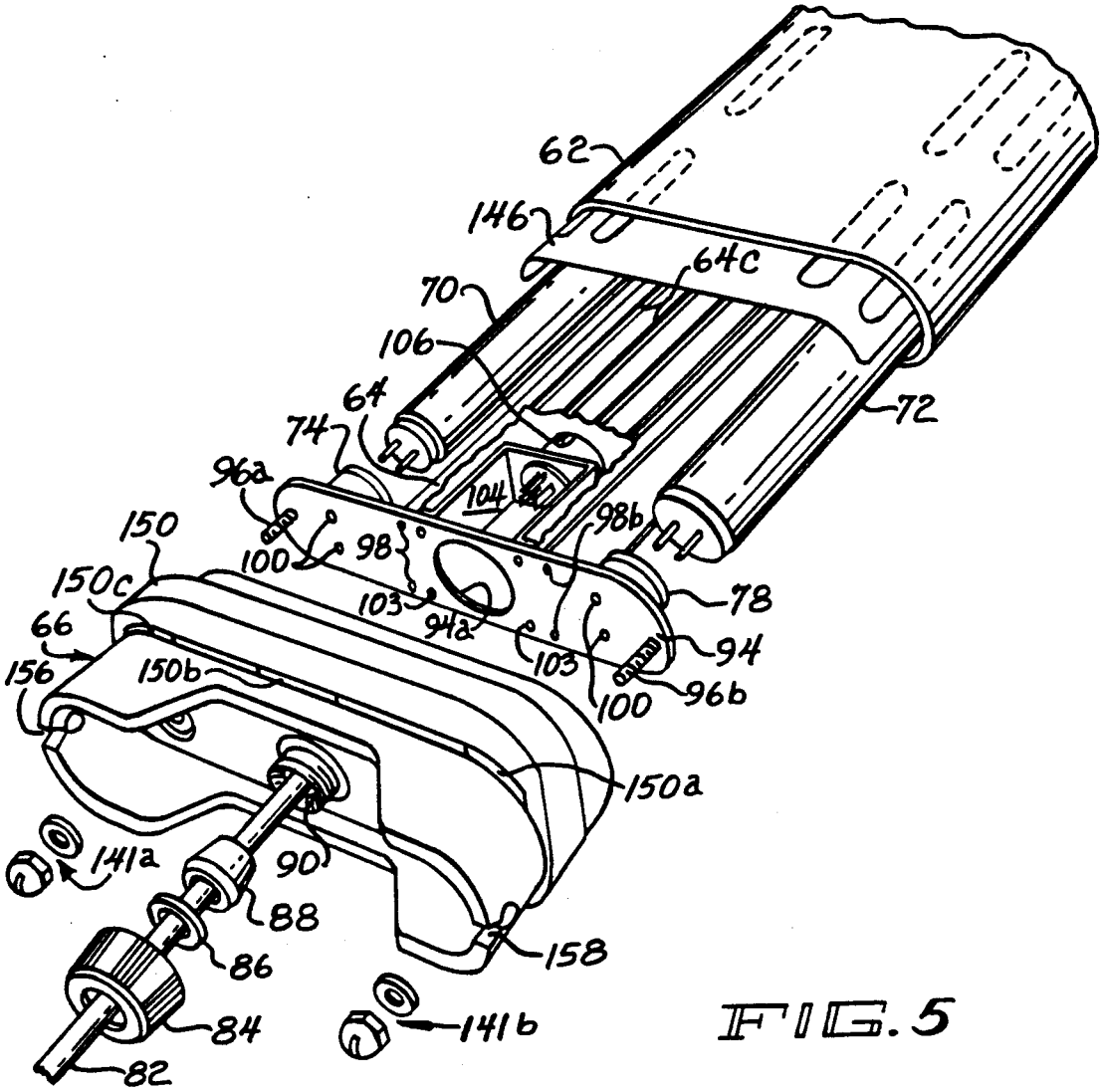
FIG. 5 is an exploded perspective view shown partially cut-away of an end portion of a portable fluorescent lamp fixture in accordance with the present invention.

Referring to FIG. 2, there is shown a partially exploded sectional view of a portable fluorescent lamp fixture 60 in accordance with the present invention. A partially cut-away exploded perspective view of an end portion of the portable fluorescent lamp fixture 60 of FIG. 2 is shown in FIG. 5. The portable fluorescent lamp fixture 60 includes an elongated, tube-like lamp guard, or lens, 62 open at both ends. Lamp guard 62 is preferably comprised of butyrate or polycarbonate. Attached to respective ends of lamp guard 62 are first and second end caps 66 and 68 as well as first and second lamp holder support plates 94 and 128 as described in detail below. End caps 66, 68 are comprised of an impact absorbing elastomer, with PARACRIL OZO rubber used in a preferred embodiment, while support plates 94, 128 are preferably comprised of a high strength, rigid material such as metal.

Figure 3:
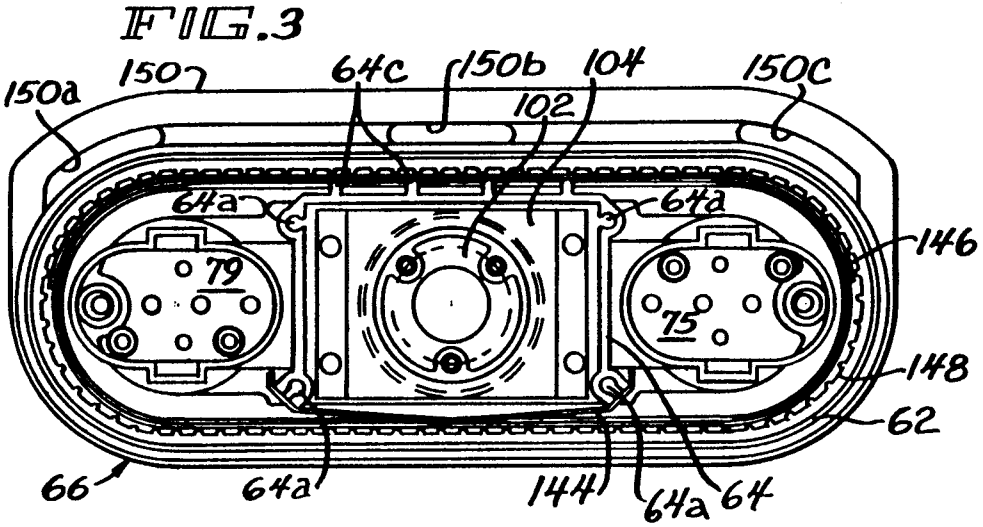
FIG. 3 is a sectional view of the portable fluorescent lamp fixture shown in FIG. 2 taken along site line 3—3 therein.

Disposed within lamp guard 62 and extending substantially the entire length thereof is a center channel, or raceway, 64 having an open lower portion as shown in the sectional view of FIG. 3 taken along site line 3—3 in FIG. 2. The open slot-like lower portion of the center channel 64 extends the entire length of the channel providing the channel with an inverted "U" cross-section. Center channel 64 is preferably comprised of a high strength, lightweight metal such as aluminum. Disposed on each side of the center channel 64 and extending substantially the entire length thereof are first and second fluorescent lamps 70 and 72.

Each end of the center channel 64 includes a plurality of mounting apertures **64*a* each adapted for receiving a respective self-tapping mounting screw 98 inserted through an aperture within the first and second lamp holder support plates 94, 128 for securely attaching the lamp holder support plates to respective ends of the center channel. Apertures within the lamp holder support plates, as shown for the case of the first lamp holder support plate 94 in FIG. 5, are adapted for receiving lamp holder mounting screws 100 which engage and securely mount each of the four lamp holders 74, 76, 78 and 80 to a respective one of the lamp holder support plates. Each of the lamp holders 74, 76, 78 and 80 is adapted to receive and securely engage the end pins of the fluorescent lamps 70, 72 for maintaining the fluorescent lamps securely in position within the fixture and for electrically coupling the fluorescent lamps to associated circuitry and wiring within the portable fluorescent lamp fixture 60. The spacing and arrangement of the various apertures in, as well as the position of the center channel mounting screws 98 and lamp holder mounting screws 100 on the first lamp holder support plate 94 are shown in FIG. 5**.

Disposed on opposed end portions of the first lamp holder support plate 94 are a pair of welded-on studs **96*a* and 96*b*. Similarly, disposed on the outer surface of the second lamp holder support plate 128 adjacent respective opposed ends thereof are welded-on studs 128*a* and 128*b*. Mounting studs 96*a*, 96*b* are adapted for insertion through respective slots 66*a* and 66*b* within the first end cap 66. First and second combinations of a nylon cap nut and washer 141*a* and 141*b* are adapted for attachment to mounting studs 96*a*, 96*b*, respectively, for securely mounting the first end cap 66 to the first lamp holder support plate 94. A similar mounting arrangement for the second end cap 68 includes first and second combinations of a nylon cap nut and washer 142*a*, 142*b* for attachment to mounting studs 128*a*, 128*b*, respectively, for securely mounting the second end cap to the second lamp holder support plate 128**.

Each of the end caps 66, 68, which are essentially identical in size and configuration, includes an inner recessed portion 154 facing an adjacent end plate and an outer recessed portion 152 facing away from the portable fluorescent lamp fixture 60. The end cap's inner recessed portion 154 is adapted for tight-fitting engagement with a peripheral end portion of the lamp guard 62 to provide a liquid-tight seal and isolate the various portable fluorescent lamp fixture 60 components from the outside environment. Tapered inner lateral portions of the end cap's inner recessed portion 154 provide this liquid-tight seal. Facing lateral portions of the outer recessed portion 152 of each of the end caps include first and second cord holder slots 156 and 158. Each of the first and second cord holder slots 156, 158 includes a tapered outer portion and a generally circular inner portion as shown in the sectional view of FIG. 4 for securely engaging and retaining a cord connected to the portable fluorescent lamp fixture 60. These cord holder slots 156, 158 prevent damage to the cord 82 from contact with an edge portion of the first or second end cap 66, 68.

First end cap 66 includes a cut-off test switch 92 coupled to appropriate circuitry within the portable fluorescent lamp fixture 60 to allow for preventing operation of the lamp fixture in a battery back-up mode. First end cap 66 further includes a center aperture within which is inserted in a tight-fitting manner a first molded insert 90. The first molded insert 90 includes an aperture therein through which an end of the cord 82 is inserted, with the conductors (not shown) in the cord coupled to a female receptacle 102 attached to the first molded insert. A plurality of mounting screws, one of which is shown in dotted-line form as element 103 in FIG. 2, securely attach receptacle 102 to the first molded insert 90. The combination of a friction washer 86 and a rubber grommet 88 is disposed about cord 82 and inserted in the aperture of the first molded insert 90. A compression nut 84 is securely attached to an outer threaded portion of the first molded insert 90 to provide a high strength, liquid-tight seal about cord 82 within the first end cap 66. A similar high strength, liquid-tight seal is provided for a second cord 140 in the second end cap 68, with a second molded insert 132 inserted in an aperture in the second end cap in combination with a rubber grommet 134, a friction washer 136 and a compression nut 138. Cord 140 terminates in a multi-pin plug 124 attached to an inner portion of the second end cap 68 over the second molded insert 132. As in the case of receptacle 102, plug 124 is securely attached to the second end cap 68 and insert 132 by conventional means such as mounting screws (not shown for simplicity). Thus, with power flowing from left to right in FIG. 2, the cord 82 and receptacle 102 combination allow the portable fluorescent lamp fixture 60 to be coupled to a source of power. Similarly, the combination of cord 140 and plug 124 permits another fluorescent lamp fixture (not shown) to be coupled to the portable fluorescent lamp fixture 60 shown in FIG. 2 in serially coupling virtually any number of such portable fluorescent lamp fixtures together.

Each of the first, second, third and fourth lamp holders 74, 76, 78 and 80 are coupled by suitable leads routed through apertures within the center channel 64 to circuitry and wiring within the center channel. Also disposed within the center channel 64 adjacent respective ends thereof are first and second mounting brackets 104 and 122. The first and second mounting brackets 104, 122 are respectively mounted to the first and second lamp holder support plates 94 and 128 by a plurality of mounting screws 103 as shown in FIG. 5 for the first mounting bracket. Also as shown in FIG. 5, the first mounting bracket 104 is mounted in alignment with an aperture 94*a* within the first lamp holder support plate 94. The second mounting bracket 122 is similarly mounted to the second lamp holder support plate 128 in alignment with an aperture therein. A plug 106 is inserted in an aperture in the first mounting bracket 104 in a tight-fitting manner. Similarly, a receptacle 120 is inserted in an aperture in the second mounting bracket 122 in a tight-fitting manner. Plug 106 and receptacle 120 are coupled by means of respective sets of wires to circuitry described below within the center channel 64. With plug 106 and receptacle 120 securely attached to the first and second mounting brackets 104 and 122, respectively, and with each of the first and second mounting brackets securely attached to a respective one of the lamp holder support plates, the plug and receptacle are maintained in fixed position adjacent to a respective aperture at each of the first and second lamp holder support plates 94 and 128.

Positioning of the first end cap 66 on one end of the lamp guard 62 and over the first lamp holder support plate 94 causes the female receptacle 102 to be inserted through the center aperture 94*a* within the first lamp holder support plate. This causes receptacle 102 to mate with plug 106 disposed within the center channel 64. This allows power to be provided to the portable fluorescent lamp fixture 60 via power cord 82. Similarly, when the second end cap 68 is positioned on the other end of lamp guard 62 and over the second lamp holder support plate 128, plug 124 is inserted through a center aperture within the support plate so as to mate with receptacle 120 within the center channel 64. This connection comprised of receptacle 120 and plug 124 allows for serially coupling the portable fluorescent lamp fixture 60 to another similar lamp fixture in forming a string of virtually any number of such fluorescent lamp fixtures. The plug/receptacle connection integral with each of the first and second end caps 66 and 68 allows for quick disconnect of the portable fluorescent lamp fixture 60 from cords 82 and 140 for lamp fixture maintenance or replacement. This quick disconnect feature also facilitates replacement of a damaged cord together with its associated end cap for reducing lamp fixture down time and maintenance costs.

As stated above, the first, second, third and fourth lamp holders 74, 76, 78 and 80 are coupled by appropriate wiring to circuitry within the center channel 64 as shown in FIG. 2. Circuitry within the center channel 64 may include a terminal board 110, a ballast 114 and a battery back-up unit 116. Each of these circuit components is attached to an inner surface of the center channel 64 by conventional means such as mounting screws. As shown in the sectional view of FIG. 3, the open lower portion of the center channel 64 is adapted for receiving a snap-on cover 144. Snap-on cover 144 extends over and engages the lower corner portions of the center channel 64. The snap-on cover 144 is maintained in position on the lower portion of the center channel 64 by its bent edge portions which are urged inwardly by pre-biasing of the cover 144. Snap-on cover 144 is preferably comprised of a metal such as steel or aluminum, but also may be comprised of a resilient, high strength, insulating plastic material and extends the full length of the center channel 64. Plug 106 and receptacle 120 and all other wiring and circuitry associated with the portable fluorescent lamp fixture 60 are thus located within the combination of center channel 64 and its snap-on cover 144.

As shown in the sectional view of FIG. 3, a reflector 146 is disposed above center channel 64 and lamp holder 75 and 79 and the fluorescent lamps attached thereto. Reflector 146 is preferably comprised of polished reflective aluminum with an acrylic coating to prevent tarnishing and may be a solid piece or slotted as shown in FIG. 5. A slotted reflector allows some of the light from the fluorescent lamps to be directed upward above the lamp fixture. Reflector 146 is under tension within the lamp guard 62 and is maintained in position by engaging a portion of the lamp guard's inner surface along the length thereof. Reflector 146 is further maintained in position by means of a plurality of spaced ribs 64*c* on an upper surface of the center channel 64. Reflector 146 is slid into position in the portable fluorescent lamp fixture 60 on the center channel ribs 64*c*. Ribs 64*c* also provide additional structural support for the center channel 64 and increase its resistance to bending. Reflector 146 may also be positioned in a lower portion of the lamp guard 62 beneath the fluorescent lamps to provide only upward directed light, or the reflector may be removed from the fixture to permit omni-directional light dispersal about the fixture. It should also be noted that, while the other figures show an installation for T12, T10 or T8 types of fluorescent lamps, the lamp holders 75 and 79 are adapted for PL type fluorescent lamps. The portable fluorescent lamp fixture 60 of the present invention is adapted to accommodate all of the aforementioned types of fluorescent lamps.

As shown in FIGS. 3 and 5, the first end cap 66 includes a support bracket 150 on an upper, outer portion thereof. Support bracket 150 is formed integrally with the first end cap 66 in a preferred embodiment and includes a plurality of spaced slots 150*a*, 150*b* and 150*c*. Each of the slots 150*a*, 150*b* and 150*c* is adapted to receive a support strap or chain (not shown for simplicity) to allow the portable fluorescent lamp fixture 60 to be hung from an overhead support structure. A similar support bracket 150 is located on an upper, outer portion of the second end cap 68.

Figure 4:
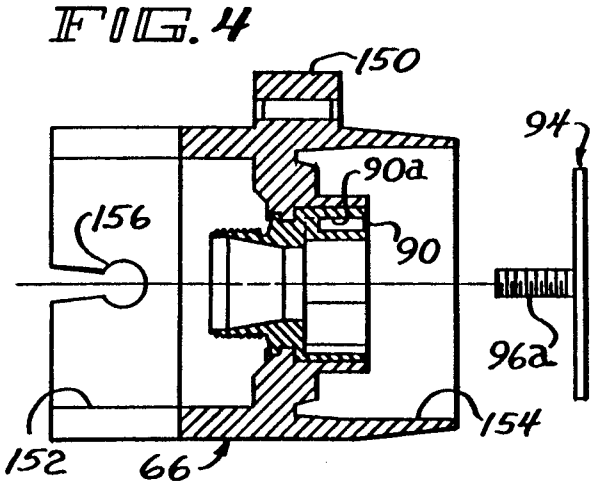
FIG. 4 is a sectional view of an end cap for use in the portable fluorescent lamp fixture of the present invention.

Referring again to the lateral sectional view of the first end cap 66 shown in FIG. 4, it can be seen that the first molded insert 90 is securely mounted by means of overlapping lip arrangements within a center aperture in the first end cap 66. The outer end of the first molded insert 90 includes a threaded portion for attachment to compression nut 84 in providing a liquid-tight seal about cord 82. The opposed end of the first molded insert 90 is provided with a plurality of spaced mounting slots 90*a* (only one of which is shown in FIG. 4) for receiving a mounting screw for attaching a female receptacle 102 to the inner end of the first molded insert 90 as shown in FIG. 2. A cord (not shown in FIG. 4) is disposed within the aperture in the first molded insert 90 for electrical coupling to the aforementioned female receptacle, which is also not shown in the figure for simplicity.

There has thus been shown an improved portable fluorescent lamp fixture incorporating a pair of easily removable end caps each having an electrical connector and cord combination integral therewith to allow the fluorescent lamp fixture to be coupled to a power source or to other similar fixtures while providing a quick disconnect feature for the fluorescent lamp fixture. Plug and receptacle connectors disposed within adjacent ends of a center channel extending down the middle of the portable fluorescent lamp fixture and enclosing lamp circuitry and wiring provide a plug-in connection to each of the first and second end caps. A removable cover on the center channel allows for easy access to the circuitry and wiring therein for maintenance and replacement. The center channel provides a rugged and strong core structure for the portable fluorescent lamp fixture and is securely attached at its respective ends to the end caps in a liquid-tight seal.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A portable fluorescent lamp fixture including a plurality of fluorescent lamps and associated circuitry and wires, said portable fluorescent lamp fixture comprising: elongated, tube-like lamp guard means open at both ends for enclosing said fluorescent lamps; first and second support plates each disposed on a respective end of said lamp guard means; a plurality of lamp holders attached to each of said first and second support plates for engaging respective ends of said fluorescent lamps and coupling said fluorescent lamps to said circuitry and wires; channel support means disposed within said lamp guard means and coupled at respective ends thereof to each of said first and second end plate means for substantially enclosing and maintaining said circuitry and wires in position within said lamp fixture; removable cover means disposed on said channel support means and over said circuitry and wires for enclosing said circuitry and wires; first and second end caps removably coupled to said first and second support plates, respectively; and quick disconnect coupling means for electrically coupling the portable fluorescent lamp fixture to a source of power, said coupling means including a receptacle integral with said first end cap and removable therewith and a plug coupled to said first support plate and disposed within said channel support means and coupled to the circuitry and wires therein.

2. The portable fluorescent lamp fixture of claim 1 further comprising second quick disconnect coupling means coupled to said second end cap for electrically coupling said portable fluorescent lamp fixture to another similar portable fluorescent lamp fixture.

3. The portable fluorescent lamp fixture of claim 2 wherein said second quick disconnect coupling means includes a plug integral with said second end cap and removable therewith and a receptacle coupled to said second support plate and disposed within said channel support means.

4. The portable fluorescent lamp fixture of claim 2 wherein said first and second end caps each include cord protection means for securing a cord coupled to an end cap in a protected position within the end cap.

5. The portable fluorescent lamp fixture of claim 4 wherein said cord protection means includes a retaining slot in an edge of an end cap for engaging and securely maintaining a cord in position on the end cap.

6. The portable fluorescent lamp fixture of claim 5 wherein each retaining slot includes a tapered outer portion and an enlarged inner portion for engaging and holding a cord in position.

7. The portable fluorescent lamp fixture of claim 2 wherein said removable cover means engages and is disposed over a lower open portion of said channel support means and along the length of said channel support means.

8. The portable fluorescent lamp fixture of claim 7 wherein said removable cover means engages said channel support means in a snap-acting manner.

9. The portable fluorescent lamp fixture of claim 1 wherein said circuitry includes a terminal block disposed in said channel support means and coupled to said wires.

10. The portable fluorescent lamp fixture of claim 1 further comprising an upper reflector and a lower lens disposed within said lamp guard means and above and below said fluorescent lamps, respectively.

11. The portable fluorescent lamp fixture of claim 10 wherein an upper portion of said channel support means includes a plurality of spaced ribs engaging said upper reflector.

12. The portable fluorescent lamp fixture of claim 1 wherein said end caps are comprised of rubber.

13. The portable fluorescent lamp fixture of claim 1 wherein said lamp guard means is comprised of butyrate or polycarbonate.

14. The portable fluorescent lamp fixture of claim 1 wherein said channel support means is comprised of extruded aluminum.

15. A portable fluorescent lamp fixture for supporting and illuminating first and second fluorescent lamps, said fluorescent lamp fixture comprising: an elongated tube-like translucent lens open at both ends for enclosing said first and second fluorescent lamps; center channel means disposed intermediate said first and second fluorescent lamps for substantially enclosing circuitry an wiring associated with said fluorescent lamps and for reinforcing and strengthening said fluorescent lamp fixture, said center channel means including an opening in a lower portion and extending the length thereof; a quick release cover disposed over said opening and engaging said center channel means in a snap-acting manner; first and second end caps removably coupled to respective ends of said center channel means; and first quick disconnect coupling means disposed in said first end cap and on a first end of said center channel means and second quick disconnect coupling means disposed in said second end cap and on a second end of said center channel means for facilitating coupling said portable fluorescent lamp fixture to or decoupling said portable fluorescent lamp fixture from a power source or another similar portable fluorescent lamp fixture.

16. A portable fluorescent lamp fixture comprising:

an elongated, tube-like lens means open at both ends for enclosing a plurality of fluorescent lamps;

channel support means disposed intermediate said fluorescent lamps and extending substantially the entire length of said lens means for enclosing lamp fixture circuitry and strengthening the lamp fixture;

first and second support plate means disposed at respective ends of said channel support means for engaging respective ends of each of said fluorescent lamps and providing support therefor and for electrically coupling said fluorescent lamps to said lamp fixture circuitry;

first and second end cap means respectively coupled to said first and second support plate means for providing a seal at each end of said lens means;

first and second cords respectively extending from said first and second end cap means for electrically coupling the lamp fixture to another portable fluorescent lamp fixture as well as to a power source; and first and second cord protection slots respectively disposed in said first and second end cap means for receiving a respective one of said cords and preventing damage to the cord from an edge of one of said end cap means.

* * * * *